US010210677B2

(12) United States Patent
Walker et al.

(10) Patent No.: US 10,210,677 B2
(45) Date of Patent: Feb. 19, 2019

(54) SYSTEMS AND METHODS OF DETERMINING CAUSES OF PERFORMANCE DEFICIENCIES OF VEHICLES

(71) Applicant: Freeport-McMoRan Inc., Phoenix, AZ (US)

(72) Inventors: Mary Amelia Walker, Phoenix, AZ (US); Robert Catron, Phoenix, AZ (US); D. Bradley Brown, Phoenix, AZ (US)

(73) Assignee: Freeport-McMoRan Inc., Phoenix, AZ (US)

( * ) Notice: Subject to any disclaimer, the term of this patent is extended or adjusted under 35 U.S.C. 154(b) by 0 days.

(21) Appl. No.: 15/426,755

(22) Filed: Feb. 7, 2017

(65) Prior Publication Data

US 2017/0236341 A1 Aug. 17, 2017

Related U.S. Application Data

(60) Provisional application No. 62/294,023, filed on Feb. 11, 2016.

(51) Int. Cl.
*G07C 5/08* (2006.01)
*G07C 5/00* (2006.01)

(52) U.S. Cl.
CPC ..... *G07C 5/0808* (2013.01); *G07C 5/0825* (2013.01); *G07C 5/008* (2013.01)

(58) Field of Classification Search
CPC ..... G07C 5/0808; G07C 5/006; G07C 5/12; G07C 5/0841; G07C 5/0816
See application file for complete search history.

(56) References Cited

U.S. PATENT DOCUMENTS 6,434,512 B1 8/2002 Discenzo
9,691,025 B2 * 6/2017 Kirsch ..... G06N 5/022
(Continued)

OTHER PUBLICATIONS

PCT International Search Report and Written Opinion, dated Apr. 17, 2017, corresponding to PCT Application No. PCT/US2017/016966, 14 pages.

*Primary Examiner* — Jelani A Smith
*Assistant Examiner* — Mathew Franklin Gordon
(74) *Attorney, Agent, or Firm* — Fennemore Craig, P.C.

(57) ABSTRACT

A method of determining a cause of a performance deficiency of a vehicle may include: Determining whether the vehicle is operating in a defined load condition; comparing an actual vehicle performance parameter with a predetermined baseline performance parameter for the defined load condition; comparing a plurality of key indicator values of the vehicle with a predetermined specification for each of the plurality of key indicator values; concluding that the performance deficiency is the result of a mechanical condition of the vehicle when at least one of the key indicator values is outside of the predetermined specification for a corresponding key indicator value and when the actual vehicle performance parameter is outside of the predetermined baseline performance parameter; and concluding that the performance deficiency is the result of an operational condition when none of the key indicator values is outside of the predetermined specification for the corresponding key indicator value and when the actual vehicle performance parameter is outside of the predetermined baseline performance parameter.

20 Claims, 7 Drawing Sheets

(56) References Cited

U.S. PATENT DOCUMENTS

| | | | | |
|---|---|---|---|---|
| 9,767,655 | B2 * | 9/2017 | Yang | G08B 1/08 |
| 9,835,094 | B2 * | 12/2017 | Lahti | F02D 9/04 |
| 2006/0123784 | A1 | 6/2006 | Algrain | |
| 2006/0253236 | A1 * | 11/2006 | Hawkins | G01P 21/02<br>701/29.2 |
| 2013/0231806 | A1 | 9/2013 | Bailey et al. | |
| 2014/0332307 | A1 * | 11/2014 | Larson | B60K 17/08<br>180/366 |
| 2015/0198445 | A1 | 7/2015 | Casson et al. | |
| 2015/0332524 | A1 | 11/2015 | Johannsen | |
| 2016/0146136 | A1 * | 5/2016 | Surnilla | F02D 17/02<br>123/568.21 |

* cited by examiner

74

| MINE SITE | TRUCK TYPE A | | | | TRUCK TYPE B | | | | MIXED FLEET IMPACT | G.V.W. (1000s LBS) | | % OF TIME >10.1% GRADE | % SLOW (MECH.) |
|---|---|---|---|---|---|---|---|---|---|---|---|---|---|
| | SPEED | | % OF TIME TRANS. IN 2ND GEAR | % OF TIME OPER SELECT 1ST GEAR | SPEED | | % OF TIME TRANS. IN 2ND GEAR | % OF TIME OPER SELECT 1ST GEAR | | TRUCK TYPE A | TRUCK TYPE B | | |
| | AVG | MODE | | | AVG | MODE | | | | | | | |
| A | 7.0 | 6.8 | 36% | 79% | 7.9 | 8.1 | 85% | 49% | N | 851 | 873 | 0% | 3% |
| B | 6.5 | 6.8 | 7% | 76% | - | - | - | - | | 876 | | 4% | 12% |
| C | 6.6 | 6.8 | 10% | 93% | 7.5 | 6.8 | 58% | 65% | ? | 856 | 884 | 1% | 23% |
| D | 6.5 | 6.2 | 11% | 78% | 6.8 | 6.2 | 30% | 57% | Y | 887 | 904 | 13% | 31% |
| E | 6.5 | 6.8 | 6% | 94% | - | - | - | - | | 881 | | 27% | 16% |
| F | 6.9 | 5.9 | 41% | 60% | - | - | - | - | | 863 | | 4% | 22% |

76 80 92 84 88 92 78 82 92 86 92 90

FIG.7

SYSTEMS AND METHODS OF DETERMINING CAUSES OF PERFORMANCE DEFICIENCIES OF VEHICLES

CROSS-REFERENCE TO RELATED APPLICATION

This application claims the benefit of U.S. Provisional Patent Application No. 62/294,023, filed on Feb. 11, 2016, which is hereby incorporated herein by reference for all that it discloses.

TECHNICAL FIELD

The present invention relates to systems and methods of managing vehicle travel in general and more particularly to systems and methods of determining causes of performance deficiencies of off-road vehicles traveling under heavily- or fully-loaded conditions.

BACKGROUND

Mining operations typically utilize fleets of specialized vehicles that are adapted for heavy haul utilization. Such vehicle fleets, include, for example, off road haul trucks that are used to carry excavated material throughout the mine. The overall efficiency and productivity of the mining operation is in part related to how well the various vehicles, including the haul truck fleet, perform. While various types of fleet management systems have been developed and are currently being used to manage such vehicle fleets, additional improvements to fleet operations are constantly being sought.

SUMMARY OF THE INVENTION

A method of determining a cause of a performance deficiency of a vehicle may include: Determining whether the vehicle is operating in a defined load condition; comparing an actual vehicle performance parameter with a predetermined baseline performance parameter for the defined load condition when the vehicle is operated in the defined load condition; comparing a plurality of key indicator values of the vehicle with a predetermined specification for each of the plurality of key indicator values; concluding that the performance deficiency is the result of a mechanical condition of the vehicle when at least one of the key indicator values is outside of the predetermined specification for a corresponding key indicator value and when the actual vehicle performance parameter is outside of the predetermined baseline performance parameter; and concluding that the performance deficiency is the result of an operational condition when none of the key indicator values is outside of the predetermined specification for the corresponding key indicator value and when the actual vehicle performance parameter is outside of the predetermined baseline performance parameter.

Also disclosed is a method of determining causes of performance deficiencies of an off-road vehicle may include the steps of: Determining whether the vehicle is in a full-pull condition; measuring a ground speed of the vehicle in the full-pull condition; determining whether the measured ground speed is below a predetermined ground speed value; measuring a plurality of key indicator values of the vehicle when the measured ground speed is below the predetermined ground speed value; determining whether at least one of the measured plurality of key indicator values is outside of a predetermined specification for the corresponding key indicator value; concluding that low measured ground speed is the result of a mechanical condition when at least one of the measured plurality of key indicator values is outside of specification; and concluding that low measured ground speed is the result of an operational condition when none of the measured plurality of key indicator values is outside of specification.

Yet also disclosed is a non-transitory computer-readable storage medium having computer-executable instructions embodied thereon that, when executed by at least one computer processor cause the processor to: Determine when an off-road vehicle is in a full-pull condition; determine a ground speed of the vehicle in the full-pull condition; determine whether the ground speed is below a predetermined ground speed value; receive from a vehicle sensing system a plurality of key indicator values of the vehicle when the around speed is below the predetermined ground speed value; determine whether at least one of the received plurality of key indicator values is outside of a predetermined specification for the corresponding key indicator value; conclude that low ground speed is the result of a mechanical condition when at least one of the plurality of key indicator values is outside of specification; and conclude that low ground speed is the result of an operational condition when none of the measured plurality key indicator values is outside of specification.

Still yet also disclosed is a system for determining causes of performance deficiencies of an off-road vehicle that may include a network. A plurality of sensors operatively associated with the off-road vehicle and the network sense at least a plurality of key indicator values during vehicle operation. A processing system operatively associated with the network is also operatively connected to a display system. The processing system is configured to determine whether the vehicle is in a full-pull condition; determine a ground speed of the vehicle in the full-pull condition; determine whether the ground speed is below a predetermined ground speed value; determine whether at least one of the plurality of key indicator values is outside of a predetermined specification for the corresponding key indicator value; conclude that low ground speed is the result of a mechanical condition when at least one of the plurality of key indicator values is outside of specification; conclude that low measured ground speed is the result of an operational condition when none of the measured plurality key indicator values is outside of specification; and display on the display system at least information relating to the conclusions.

BRIEF DESCRIPTION OF THE DRAWINGS

Illustrative and presently preferred exemplary embodiments of the invention are shown in the drawings in which:

FIG. 7 is a 'slow truck matrix' of operational data collected from two different truck types operating at the various exemplary mine sites.

DETAILED DESCRIPTION OF THE PREFERRED EMBODIMENTS

Figure 1:
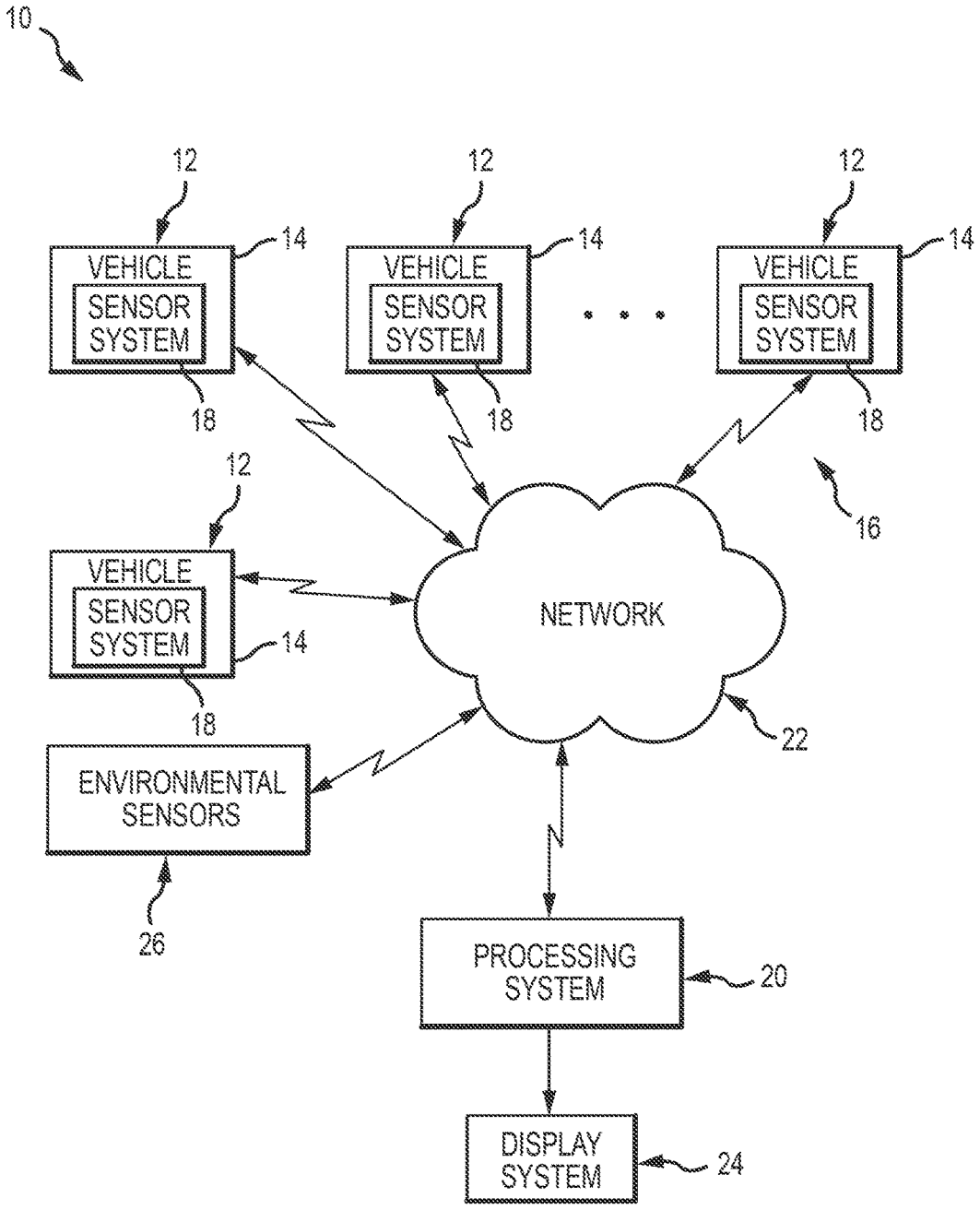
FIG. 1 is a schematic representation of one embodiment of a system for optimizing the performance of off-road vehicles according to the present invention.

One embodiment of a system 10 for determining causes of performance deficiencies of vehicles is shown in FIG. 1 as it could be used to determine causes of poor performance of one or more vehicles 12, such as off-road haul trucks 14, operating at one or more mine sites 16. As will be explained in further detail herein, each vehicle 12 or haul truck 14 may be provided with a vehicle sensing system 18 for sensing certain operational parameters and conditions of the vehicle 12 during operation. The sensing system 18 associated with each vehicle may be operatively connected to a processing system 20, e.g., via a network system 22. Processing system 20 processes information and data from the vehicle sensing system 18 in accordance with the teachings provided herein in order to determine causes of poor performance of the vehicles 12. Thereafter, information and data relating to vehicle performance, including the causes of poor vehicle performance, if detected, may be displayed on one or more display systems 24. In some embodiments, system 10 may also comprise one or more environmental sensors 26 that are also operatively connected to processing system 20 (e.g., via network system 22). The environmental sensors 26 sense the state of certain environmental conditions, such as temperature, humidity, or barometric pressure, at one or more locations throughout the mine site 16.

Figure 2:
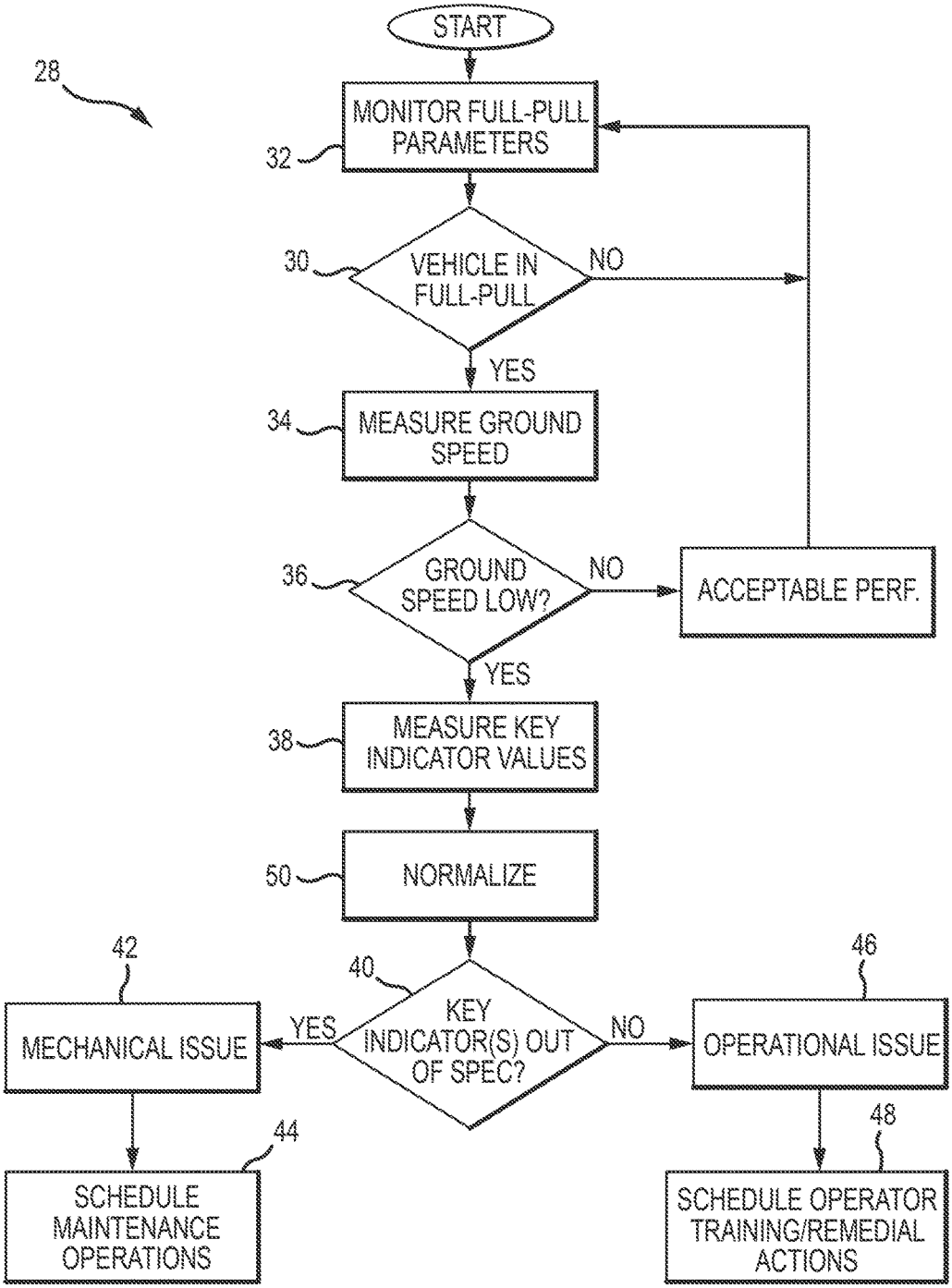
FIG. 2 is a flow chart of one embodiment of a method of optimizing the performance of off-road vehicles according to the present invention.

With reference now to FIG. 2, the various components of the system 10 may be configured or programmed to operate in accordance with a method 28 to determine causes of performance deficiencies of one or more vehicles 12 when they are operating in a defined load condition. In one embodiment, the defined load condition may comprise a heavily- or fully-loaded condition, also referred to herein in the alternative as a "full-pull" condition. Alternatively, other load conditions may be defined. Broadly speaking, method 28 generally involves determining (e.g., during step 30) when the vehicle 12 (e.g., a haul truck 14) is operating in the defined load condition, such as the full-pull condition. In one embodiment, this determination is made by monitoring, during step 32, certain load condition or "full-pull" parameters transmitted by the vehicle sensing system 18 and received by the processing system 20. If the load condition or full-pull parameters are indicative of the desired (e.g., full-pull) load condition, then method 28 proceeds to step 34 in which some vehicle performance parameter, such as ground speed, is determined or measured. If the determined or measured ground speed is equal to greater than a predetermined threshold or value, as may be determine in step 36, then the method determines that the performance of the vehicle(s) 12 is acceptable or satisfactory. Method 28 may then continue to monitor the various full-pull parameters at step 32.

On the other hand, if the determined or measured ground speed of the vehicle 12 is below the predetermined threshold or value, as determined in step 36, then method 28 proceeds to step 38. During step 38, certain "key indicator values" are sensed by the vehicle sensing system 18 and transmitted to the processing system 20. The received key indicator values are then analyzed by processing system 20 during step 40. If one or more of the key indicator values is not within a predetermined specification or range for the corresponding key indicator value, then method 28 concludes at step 42 that the poor vehicle performance is due to a mechanical condition or issue. As will be explained in further detail herein, in some embodiments, the system 10 and/or method 28 may conduct further analysis to determine specific mechanical conditions or issues that may be the cause of the poor vehicle performance. Thereafter, a system operator (not shown) may schedule, at step 44, appropriate vehicle maintenance operations to address the issue.

If, however, none of the key indicator values are out of specification (e.g., as determined during step 40), then method 28 concludes at step 46 that the poor vehicle performance is due to an operational condition or issue. Operational conditions or issues leading to poor vehicle performance may include issues relating to techniques and procedures followed by the vehicle operator, i.e., the way in which the vehicle operator operates the vehicle 12. Operational conditions or issues may also include environmental factors, such as issues relating to road conditions, road quality, and/or road design. In some embodiments, the system 10 and/or method 28 may conduct further analysis to determine specific operational conditions or issues that may be the cause of the poor vehicle performance. Thereafter, the system operator may schedule, at step 48, appropriate operator training, road improvements, or other appropriate remedial measures to address the identified operational conditions or issues.

A significant advantage of the present invention is that it may be used to not only to identify those vehicles that are performing poorly, but also to determine the likely causes of the poor vehicle performance. For example, while prior art systems and methods are typically capable of determining when vehicle performance is below expectations or standards, they cannot readily determine why the vehicle performance was deficient, thereby making it difficult to address and/or correct the source of the deficiency. The systems and methods of the present invention represent a significant advantage because they can identify not only those vehicles that are performing poorly, but also the likely cause or causes of the poor vehicle performance. Still further, the systems and methods of the present invention may also be used to determine whether the cause or causes of the poor vehicle performance are due to some mechanical issue or problem with the vehicle itself, or are instead due to some operational factor, such as poor operator technique or environmental conditions.

Having briefly described certain exemplary embodiments of systems and methods of the present invention, as well as some of its more significant features and advantages, various embodiments and variations of the present invention will now be described in detail. However, before proceeding the description, it should be noted that while various embodiments are shown and described herein as they could be used to determine likely causes of performance deficiencies of off-road haul trucks of the type commonly used in open pit mining operations, the systems and methods of the present invention could also be used in conjunction with any of a wide range of vehicles or fleets of vehicles operating in any of a wide range of environments and performing any of a wide range of missions.

Referring back now to FIG. 1, an exemplary embodiment of the system 10 for determining causes of performance deficiencies or poor performance of vehicles 12 is shown and described herein as it could be used in conjunction with one or more off-road haul trucks 14 operating at one or more mine sites 16. Although the vehicles 12 in the exemplary embodiment may comprise off-road haul trucks 14, it should be understood that the systems and methods of the present invention may be used in conjunction with other types of vehicles, in other environments, and to perform different missions or tasks, as would become apparent to persons having ordinary skill in the art after having become familiar with the teachings provided herein. Consequently, the present invention should not be regarded as limited to any particular vehicle type operating in any particular environment. However, by way of example, in one embodiment, the various haul trucks 14 comprise one of two models or types of haul trucks, specifically a model 'B/C' or a model 'D' of a type 793 diesel powered off-road haul truck manufactured by Caterpillar, Inc. of Peoria, Ill. (US). Hereinafter, the 793 B/C model will be referred to herein as truck type 'A,' whereas the 793 D model will be referred to herein as truck type 'B.'

Still referring to FIG. 1, each haul truck 14 may be provided with a sensor system 18 for sensing various operational states and parameters associated with a wide variety of vehicle systems. Exemplary vehicle systems and parameters that may be sensed by the vehicle sensing system 18 include, but are not limited to, engine systems, cooling systems, hydraulic systems, transmission systems, and suspension systems. Each vehicle sensing system 1S may al so sense information and data relating to the kinematic state of the vehicle 12, including vehicle position, speed, acceleration, and heading, although other information and data may be sensed as well.

In the particular embodiments shown and described herein, each vehicle sensing system 18 may comprise a plurality of individual sensors (not shown) that are operatively associated with the various systems and devices being monitored. Vehicle sensing system 18 may also comprise an associated vehicle data network or networks (not shown) that provide data sensing and reporting functionalities to facilitate the monitoring of the various vehicle components, states, and systems, as described herein. By way of example, such vehicle networks may include, but are not limited to, Local Interconnect Networks ("LIN," e.g., configured in accordance with ISO 1941 and ISO 17987), which are commonly used for low data rate applications; Controller Area Networks ("CAN," e.g. configured in accordance with ISO 11898) for medium data rate applications; and "FlexRay" (e.g., configured in accordance with ISO 17458), which is often used for safety-critical applications. A vehicle 12 may be provided with more than one vehicle network.

Before proceeding with the description, it should be noted that vehicle sensor systems, such as vehicle sensor system 18, suitable for monitoring various vehicle components, systems, and states, are well-known in the art and are commonly provided as OEM equipment on a wide range of vehicles. Therefore, the particular vehicle sensor system 18 that may be utilized in conjunction with the present invention will not be described in further detail herein.

Regardless of the particular type of vehicle sensor system 18 that is utilized on the vehicles 12, the vehicle sensor system 18 (e.g., comprising a plurality of sensors and associated vehicle network(s), as described above) may be operatively connected to a processing system 20 via network system 22. In many embodiments, network system 22 will comprise a combination of wireless and wired networks in order to facilitate the transfer of information and data from the vehicle sensor systems 18 to processing system 20. By way of example, in one embodiment, network system 22 may comprise a wireless network component (not separately shown) provided at the mine site 16. Such a wireless network may comprise a first link or component of network system 22 and may be used to capture and relay information and data from the vehicle sensing systems 18 to a local area network infrastructure (also not separately shown) provided at the mine site 16. Thereafter, a wide area network system (not shown) may be used transfer and/or relay that information and data to a centralized network infrastructure (also not shown) which may be operatively associated with processing system 20. Of course, other variations and configurations of network system 22 are possible, as would become apparent to persons having ordinary skill in the art after having become familiar with the teachings provided herein. Therefore, the network system 22 shown and described herein should not be regarded as limited to any particular components, types, architectures, or configurations.

System 10 may also comprise a processing system 20. Processing system 20 may be operatively connected to network system 22 so as to receive from the various vehicle sensor systems 18 information and data relating to the function and operation of the various vehicles 12 and systems thereof, as already described. Processing system 20 processes that information and data in accordance with the teachings provided herein in order to determine the causes of performance deficiencies of the vehicles 12. Processing system 20 may also be connected to one or more display systems 24 to allow the processing system 20 to display certain information and data relating to the operations described herein to be displayed or presented to one or more system operators, as described herein. Both processing system 20 and display system 24 may comprise any of a wide range of systems and devices that are now known in the art or that may be developed in the future that are or would be suitable for use with the present invention. Still further, because such systems are well-known in the art and could be readily provided by persons having ordinary skill in the art, the particular processing and display systems 20 and 24 that may be utilized in conjunction with the present invention will not be described in further detail herein.

In many embodiments, system 10 may also comprise one or more environmental sensors 26. Environmental sensors 26 may be used to sense certain environmental conditions, such as temperature, humidity, or barometric pressure, at one or more locations throughout the mine site(s) 16. The environmental sensors 26 also may be operatively connected to processing system 20 via network system 22. Here again, because such environmental sensors are well-known in the art and could be readily provided by persons having ordinary skill in the art after having become familiar with the teachings provided herein, the particular environmental sensors 26 that may be utilized with the present invention will not be described in further detail herein.

Referring now primarily to FIG. 2, processing system 20 may be configured or programmed to operate in accordance with a method 28 to determine causes of poor performance or performance deficiencies of one or more vehicles 12 when they are operating in a defined load condition. In the embodiments shown and described herein, each of the vehicles 12 comprises an off-road haul truck 14 of the type commonly used in open pit mining operations, although other types of vehicles or a mixture of vehicle types may be used as well.

In the particular embodiments shown and described herein, the defined load condition may comprise a heavily- or fully-loaded condition (also referred to herein in the alternative as a "full-pull" condition). Alternatively, other defined load conditions may be defined and used, as would become apparent to persons having ordinary skill in the art after having become familiar with the teachings provided herein. Method 28 determines (e.g., during step 30) when the haul truck 14 is operating in the defined load condition (e.g., a full-pull condition) by monitoring, during step 32, certain "full-pull parameters" transmitted by the vehicle sensors 18 and received by the processing system 20.

As used herein, the term "full-pull parameter" refers to those parameters that are associated with vehicle operation in a heavily- or fully-loaded condition, as may be defined by the system operator for the particular application and vehicle type. In this regard it should be noted that full pull parameters need not include all parameters associated with a fully-loaded condition or near fully-loaded condition of the vehicle 12, but rather may be limited to a select number of full-pull parameters as may be desired for any particular vehicle, application, or environment. By way of example, in one embodiment, full-pull parameters include, but need not be limited to, engine load, engine speed, throttle position, and transmission gear selection. Optionally, vehicle payload may be used as well. In one embodiment, wherein the vehicles 12 comprise truck types 'A' and 'B' referenced earlier, each haul truck 14 is determined to be in a "full pull" condition when the full-pull parameters (e.g., as sensed by the sensing system 18) are as follows:

Engine Load>98%;

Engine Speed>1600 rpm;

Throttle Position>95%; and

Transmission gear selection: $1^{st}$ or $2^{nd}$ gear.

In the particular embodiment shown and described herein, all of the full-pull parameters need to be greater than the respective values (with the transmission operating in $1^{st}$ or $2^{nd}$ gear) for the haul truck 14 to be considered in a full-pull condition. Alternatively, other embodiments may be configured or programmed to consider the vehicle to be in a full-pull condition even if some of the full-pull parameters do not meet the defined values.

Before proceeding with the description, it should be noted that the various parameters and values used by the system 10 and method 28 may be obtained from the sensor system 18 provided on each vehicle 12, as already described. While such information and data may be provided to the processing system 20 'on-demand,' i.e., in response to a specific query from processing system 20, in many embodiments, information and data from the vehicle sensing systems 18 may be provided to the processing system 20 on a substantially continuous basis, i.e., not in response to any particular query from processing system 20. Further, such information and data may be provided with a 'time stamp' to allow processing system 20 to determine the relevant time period during which the information and data were collected or obtained. In such embodiments, then, certain steps of method 28 that involve processes or steps of 'measuring,' 'monitoring,' 'determining,' 'transmitting,' or 'receiving,' may not necessarily involve contemporaneous processes or steps, but rather could involve the retrieval of previously obtained and stored data for the relevant time period.

Continuing now with the description, if the full-pull parameters are indicative of a full-pull condition, then method 28 proceeds to step 34 in which a vehicle performance parameter is determined or measured. In one embodiment, the vehicle performance parameter may comprise a ground speed of the vehicle 12. The ground speed of the vehicle 12 may be determined from data transmitted by the vehicle sensing system 18, although other arrangements are possible. In this regard it should be noted that the speed of the vehicle 12 may be measured or determined over a wide range of roads, road segments, and/or grades. For example, in one embodiment, the speed of the vehicle 12 may be measured or determined when the vehicle 12 is traveling or moving uphill, downhill, and on level ground. Therefore, the present invention should not be regarded as limited to vehicles that might be traveling only uphill.

The measured vehicle performance parameter, e.g., vehicle speed, may then be compared with corresponding predetermined or baseline performance parameter expected to be achieved by a well-performing vehicle or a vehicle that otherwise meets desired performance criteria. In an embodiment wherein the measured vehicle performance parameter is a the ground speed of the vehicle, the predetermined or baseline performance parameter may comprise corresponding threshold value previously established for the particular road, road segment, or grade. Further, such predetermined or threshold values may be established for uphill conditions (e.g., at certain specified grades), level travel, and downhill conditions (e.g., again at certain grades), as already mentioned.

If the determined or measured actual vehicle performance parameters is within the predetermined baseline parameter, e.g., if the measured ground speed is equal to or greater than the corresponding predetermined threshold or value (e.g., uphill, level, or downhill grade, as the case may be), then method 28 concludes that the performance of the vehicle(s) 12 is acceptable or satisfactory. Method 28 may then continue to monitor the various full-pull parameters at step 32, as depicted in FIG. 2.

On the other hand, if the determined or measured actual vehicle performance parameter is outside the predetermined baseline parameter, e.g., if the measured ground speed of the vehicle 12 is below the corresponding predetermined threshold or value, as determined in step 36, then method 28 proceeds to step 38. During step 38, certain "key indicator values" sensed by the vehicle sensing system 18 may be transmitted to processing system 20. Alternatively, some or all information and data relating to the key indicator values may have been previously transmitted and stored in a suitable memory system, in which case processing system 20 may access such information and data from the memory system. The received key indicator values are then analyzed by processing system 20 at step 40.

As used herein, the term "key indicator value" refers to those values that, when outside of a predetermined specification for that particular value, may be indicative of a mechanical problem with the vehicle 12. In this regard it should be noted that the term key indicator value need not include all values associated with any particular mechanical problem of the vehicle 12, but rather may be limited to a select number of key indicator values as may be desired for any particular vehicle, application, or environment. By way of example, in one embodiment, key indicator values include, but need not be limited to, intake manifold or 'boost' pressure (in the case of turbo- or supercharged engines), exhaust gas temperature, and engine de-rate percentage.

In this regard it should be noted that it may be advantageous to 'normalize' one or more of the key indicator values in order to allow the system 10 to more accurately determine when a departure from the predetermined specification is truly indicative of a mechanical problem with the vehicle 12. For example, in one embodiment, the intake manifold or boost pressure, e.g., as measured by vehicle sensing system 18, is normalized in order to allow the system 10 to more accurately determine whether a variation in boost pressure is indicative of a mechanical problem with the vehicle 12 or merely the result of environmental conditions (e.g., temperature).

Figure 3:
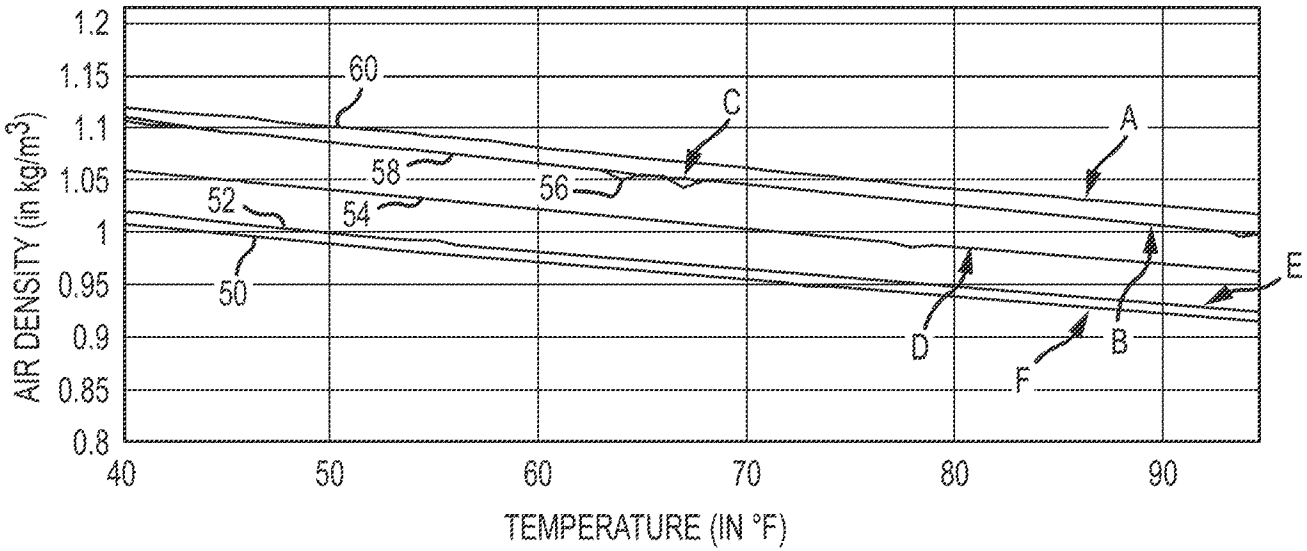
FIG. 3 is a graphical representation of air density versus temperature for 6 exemplary mine sites A-F at varying altitudes.

Referring now to FIG. 3, it is known that air density varies with ambient air temperature and atmospheric pressure. More specifically, for a given elevation, i.e., altitude above mean sea level (MSL), air density increases with decreasing temperature and vice-versa. Similarly, air density increases with decreasing elevation and vice-versa. Each line 50, 52, 54, 56, 58, and 60 illustrated in FIG. 3 illustrates the relationship between measured air density and temperature for the actual elevations at various exemplary mine sites 16, which may be referred to herein in the alternative as mine sites 'A'-'F'. Thus, in FIG. 3, line 50 is representative of the relationship between air density and air temperature at mine site 'F,' which is situated at the highest elevation, whereas line 60 is representative of the relationship between air density and air temperature at mine site 'A,' which is at the lowest elevation. Lines 52-58 represent the relationship at various respective mine sites 'B'-'E,' which are situated at various intermediate elevations.

Figure 4:
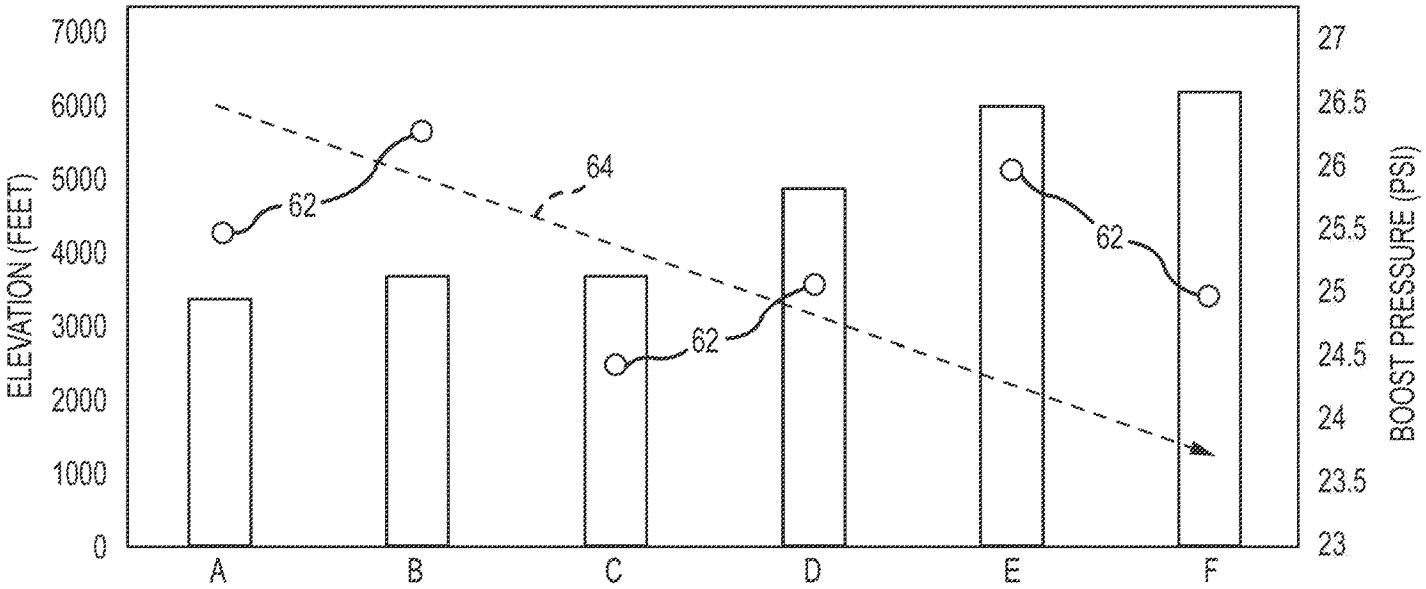
FIG. 4 is a graphical representation of measured average boost pressures for haul trucks operating at the various exemplary mine sites.

Somewhat surprisingly, and with reference now to FIG. 4, we have found that an analysis of average intake manifold or boost pressures 62 for truck model 'A' in normal operation at the various mine sites 16 (indicated by respective bars A-F in FIG. 4) indicates that intake manifold pressure variations are not highly correlated with elevation. For example, a linear relationship or correlation between elevation and measured manifold or boost pressure would be indicated by broken line 64 in FIG. 4. Clearly, the measured boost pressures 62 for haul trucks 14 operating at the various elevations are not highly correlated with elevation.

Figure 5:
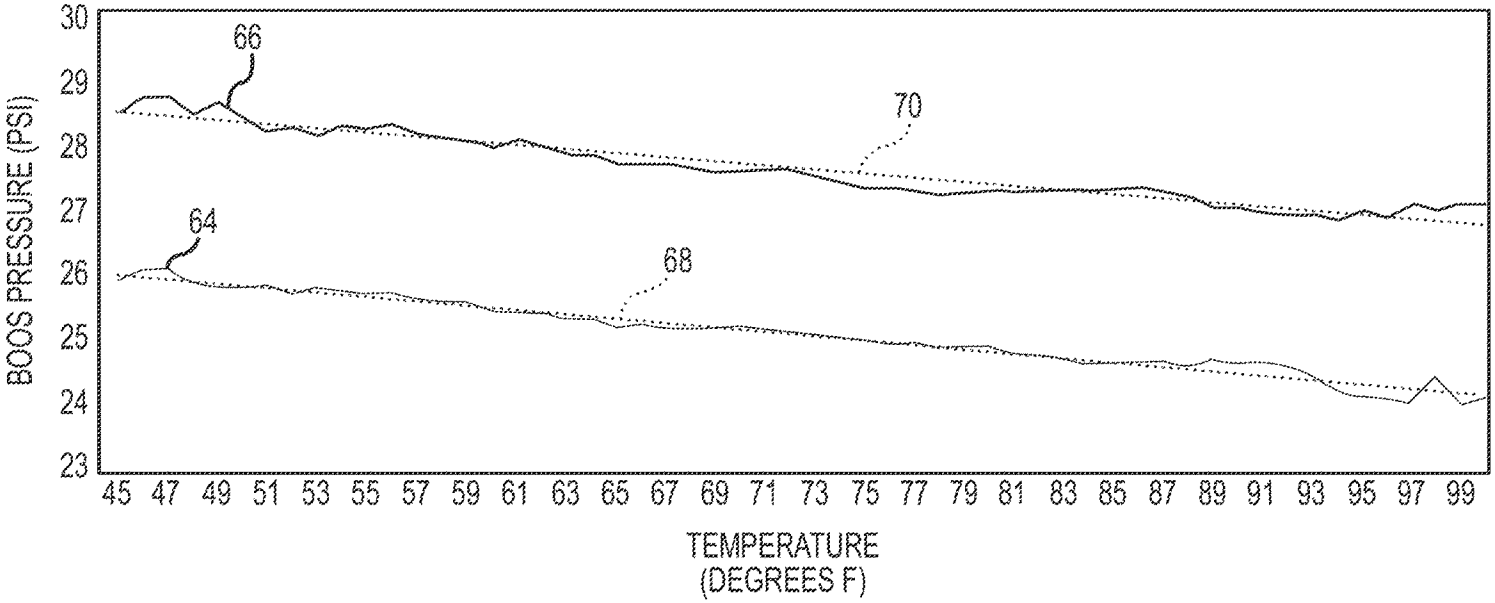
FIG. 5 is a graphical representation of measured daily average boost pressures vs. daily average ambient temperature.

However, and with reference now to FIG. 5, a similar analysis of intake manifold pressure for the two haul truck types 'A' and 'B' in normal operation revealed a strong linear relationship between daily average boost pressure and daily average ambient air temperature, as indicated by line 64 (for truck type 'A') and line 66 (for truck type 'B'). The corresponding linear relationship is indicated by dotted lines 68 and 70 for truck types 'A' and 'B,' respectively.

We have discovered that it is advantageous to normalize the measured manifold or boost pressure (e.g., as sensed by sensing system 18) to take into account the strong linear relationship between daily average boost pressure and daily average ambient temperature. The normalized intake manifold or boost pressure will therefore provide a better indication of vehicle performance than would non-normalized boost pressure. If desired, the normalization process may be performed at step 50 in method 28.

In the particular embodiment shown and described herein, the measured boost pressure $P_a$ is normalized in accordance with the following relation to produce a normalized boost pressure $P_n$ at a predetermined temperature, in this example a temperature of about 18.3° C. (about 65° F.):

$$P_n = P_a - ((T_a - 18.3°\ \text{C.}) * T_c)$$

where:

$P_n$=Normalized boost pressure at the predetermined temperature;

$P_a$=Actual or measured boost pressure;

$T_a$=Ambient air temperature (° C.); and $T_c$=Temperature coefficient.

In this particular example, the temperature coefficient, $T_c$, is selected to be the slope of the line 68 or 70 from FIG. 5 for the particular truck type (i.e., 'A' or 'B'), as the case may be.

Referring back now to FIG. 2, if one or more of the key indicator values are out of specification for the corresponding key indicator value, then the method concludes, at step 42, that the poor vehicle performance is due to a mechanical condition or issue. Thereafter, a system operator (not shown) may schedule, at step 44, appropriate vehicle maintenance operations to address the issue.

Once method 28 concludes that the low ground speed condition is the result of a mechanical condition or issue, the method 28 may be programmed or configured to conduct further analysis in accordance with a 'causation tree' 72. See FIG. 6. If desired, system 10 and method 28 may be programmed or configured to display the causation tree 72 on display system 24. Causation tree 72 may be used by a system operator to more rapidly identify possible mechanical issues or deficiencies that cause or resulted in the poor vehicle performance. For example, and with reference now to FIG. 6, a boost pressure key indicator value that is outside of specification may be indicative of the need to perform a maintenance operation on the vehicle boost system (i.e., the turbo- or supercharger system, including, but not limited to problems with gaskets, aftercooler leaks, or engine overhead issues. Boost pressure deviations from specification may also be indicative of problems with the engine control module (ECM) settings, particularly in "dual horsepower" or multi-torque engines.

Figure 6:
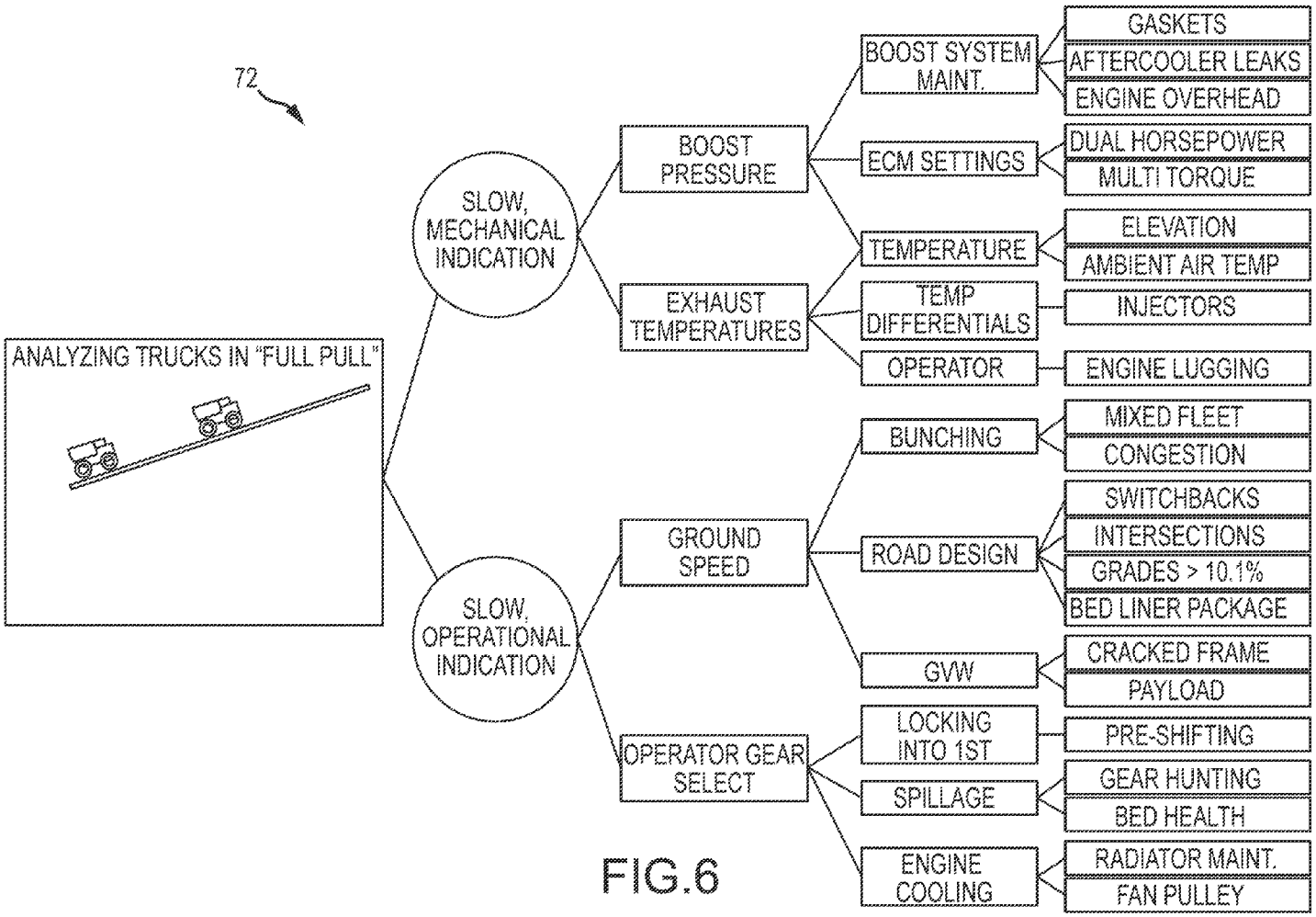
FIG. 6 is a 'causation tree' of possible root causes for determined slow mechanical and slow operational conditions.

Other indicators are also possible, as also depicted in FIG. 6. For example, an exhaust temperature key indicator value that is outside of specification may be indicative of certain environmental conditions related to elevation or ambient air temperature. Excessive temperature differentials between individual cylinders or between cylinder banks may be indicative of a problem with the fuel injection system or individual fuel injectors. Excessive temperature differentials may also be the result of certain operator issues, such as engine lugging.

Referring back now to FIG. 2, if none of the key indicator values are out of specification (e.g., as determined during step 40), then method 28 concludes, at step 46, that the poor vehicle performance is due to an operational condition or issue. As explained earlier, operational conditions or issues may include issues relating to techniques and procedures followed by the vehicle operator, i.e., the way in which the vehicle operator operates the vehicle. In addition, operational conditions or issues may also include environmental factors, such as issues relating to road conditions, road quality, and/or road design.

Here again, in some embodiments, causation tree 72 may be used to more readily identify specific operational conditions or issues that may be the cause of the poor vehicle performance, as also depicted in FIG. 6. For example, a low vehicle ground speed may be the result of vehicle 'bunching' or congestion, problems with road quality or design, and gross vehicle weight (GVW) issues. Other operational conditions may include problems with transmission gear selection, spillage, and engine cooling issues, just to name a few of those depicted in FIG. 6. Thereafter, the system operator may schedule, at step 48, appropriate operator training, road improvements, or other appropriate remedial measures to address the identified operational conditions or issues.

The system 10 and method 28 also may be configured and programmed to develop or produce a slow truck matrix 74, as illustrated in FIG. 7. Slow truck matrix 74 may be developed based on the data obtained by the vehicle sensing systems 18 of the various vehicles 12 and may be presented on display system 24. The particular matrix 74 illustrated in FIG. 7 may be configured to present data for the two truck types 'A' and 'B' operating at the various mine sites A-F. The matrix 74 may report the speed of the haul trucks 14, e.g., both the average speed and the mode. Average speed is reported in columns 76 and 78, whereas the mode is reported in columns 80 and 82. Matrix 74 also may be configured to report the percentage of time the haul trucks 14 were operated in second gear, as shown in columns 84 and 86, as well as the percentage of time the operator selected first gear, as shown in columns 88 and 90. If desired, the percentage values reported in columns 84, 86, 88, and 90 may be accompanied by corresponding magnitude bars 92 to provide an alternative designation of the reported percentage values. The magnitude bars 92 may be color-coded if desired to provide a ready indication of whether the reported percentages are within desirable ranges or values. For example, if the reported percentages are far out of range, the corresponding magnitude bars 92 may be depicted in a red color. If the reported percentages are closer to the desired range, the corresponding magnitude bars 92 may be depicted in yellow color. If the reported percentages within the desired range or values, the corresponding magnitude bars 92 may be depicted in a green color. Of course, other visual indicia may be provided.

Slow truck matrix 74 may also be configured to report additional information and data that may be helpful in analyzing the performance of the haul trucks 14. Such additional information and data may include, for example, whether any performance deficiencies are the result of a mixed fleet (i.e., different types of haul trucks 14 operating at the same mine site 16), the measured gross vehicle weight (GVW) of the haul trucks 14 when operating in the defined (e.g., full pull) load condition, as well as the percentage of time the haul trucks 14 traveled on a grade exceeding a defined limit (e.g., 10.1%). The matrix 74 may also include information relating to the percentage of time that a slow truck determination was due to a mechanical condition or issue. In some embodiments, the respective values may be displayed in various colors (e.g., red, yellow, and green) to provide a ready visual indication of whether the reported values are far, near, or within acceptable ranges for the corresponding values.

Having herein set forth preferred embodiments of the present invention, it is anticipated that suitable modifications can be made thereto which will nonetheless remain within the scope of the invention.

The invention shall therefore only be construed in accordance with the following claims:

1. A method of determining causes of performance deficiencies of an off-road vehicle, comprising:

determining whether the vehicle is in a full-pull condition;

measuring a ground speed of the vehicle in the full-pull condition;

determining whether the measured ground speed is below a predetermined ground speed value;

measuring a plurality of key indicator values of the vehicle when the measured ground speed is below the predetermined ground speed value;

determining whether at least one of the measured plurality of key indicator values is outside of a predetermined specification for the corresponding key indicator value;

concluding that low measured ground speed is the result of a mechanical condition when at least one of the measured plurality of key indicator values is outside of specification; and concluding that low measured ground speed is the result of an operational condition when none of the measured plurality of key indicator values is outside of specification.

2. The method of claim 1, further comprising:

scheduling a maintenance operation for the vehicle when the low measured ground speed is the result of the mechanical condition; and scheduling operator training when the low measured ground speed is the result of the operational condition.

3. The method of claim 1, wherein determining whether the vehicle is in a full-pull condition comprises measuring a plurality of full-pull parameters when the vehicle is in motion.

4. The method of claim 3, wherein the plurality of full-pull parameters comprises two or more selected from the group consisting of engine load, engine speed, throttle position, transmission gear selection, and payload status.

5. The method of claim 4, wherein the plurality of key indicator values comprises two or more selected from the group consisting of manifold pressure, exhaust gas temperature, and engine derate percentage.

6. The method of claim 5, further comprising normalizing at least one key indicator value before said determining whether at least one of the plurality of key indicator values is outside of specification.

7. The method of claim 6, wherein said normalizing comprises normalizing manifold pressure.

8. The method of claim 7, wherein normalizing manifold pressure comprises normalizing manifold pressure based on ambient temperature.

9. The method of claim 1, wherein measuring the ground speed of the vehicle in the full-pull condition comprises measuring the ground speed of the vehicle when the vehicle is moving uphill, downhill, and on level ground.

10. The method of claim 1, wherein concluding that low measured ground speed is the result of a mechanical condition comprises concluding that the mechanical condition is due to either manifold pressure or exhaust temperature.

11. The method of claim 1, wherein concluding that low measured ground speed is the result of an operational condition comprises concluding that the operational condition is due to either slow ground speed or transmission gear selection.

12. A method of determining a cause of a performance deficiency of a vehicle, comprising:

determining whether the vehicle is operating in a defined load condition;

comparing an actual vehicle performance parameter with a predetermined baseline performance parameter for the defined load condition when the vehicle is operated in the defined load condition;

comparing a plurality of key indicator values of the vehicle with a predetermined specification for each of said plurality of key indicator values;

concluding that the performance deficiency is the result of a mechanical condition of the vehicle when at least one of the key indicator values is outside of the predetermined specification for a corresponding key indicator value and when the actual vehicle performance parameter is outside of the predetermined baseline performance parameter; and concluding that the performance deficiency is the result of an operational condition when none of the key indicator values is outside of the predetermined specification for the corresponding key indicator value and when the actual vehicle performance parameter is outside of the predetermined baseline performance parameter.

13. The method of claim 12, wherein the vehicle comprises a land vehicle powered by an internal combustion engine and wherein said determining whether the vehicle is operating in a defined load condition comprises determining whether the vehicle is operating in a full-pull condition.

14. The method of claim 13, wherein the vehicle performance parameter comprises a ground speed and wherein said comparing the actual vehicle performance parameter with a predetermined baseline performance parameter comprises comparing the actual vehicle ground speed with a predetermined baseline ground speed when the vehicle is operated in the full-pull condition.

15. The method of claim 14, wherein the plurality of key indicator values comprises two or more selected from the group consisting of manifold pressure, exhaust gas temperature, and engine derate percentage.

16. The method of claim 14 further comprising determining whether the mechanical condition is related to manifold pressure or exhaust gas temperature.

17. The method of claim 14, wherein said determining whether the vehicle is in a full-pull condition comprises measuring a plurality of full-pull parameters when the vehicle is in motion.

18. The method of claim 17, wherein the plurality of full-pull parameters comprises two or more selected from the group consisting of engine load, engine speed, throttle position, transmission gear selection, and payload status.

19. A non-transitory computer-readable storage medium having computer-executable instructions embodied thereon that, when executed by at least one computer processor cause the processor to:

determine when an off-road vehicle is in a full-pull condition;

determine a ground speed of the vehicle in the full-pull condition;

determine whether the ground speed is below a predetermined ground speed value;

receive from a vehicle sensing system a plurality of key indicator values of the vehicle when the ground speed is below the predetermined ground speed value;

determine whether at least one of the received plurality of key indicator values is outside of a predetermined specification for the corresponding key indicator value;

conclude that low measured ground speed is the result of a mechanical condition when at least one of the plurality of key indicator values is outside of specification; and conclude that low measured ground speed is the result of an operational condition when none of the measured plurality key indicator values is outside of specification.

20. A system for determining causes of performance deficiencies of an off-road vehicle, comprising:

a network;

a plurality of sensors operatively associated with the off-road vehicle for sensing at least a plurality of key indicator values, said plurality of sensors being operatively associated with said network;

a processing system operatively associated with said network, said processing system being configured to:

determine whether the vehicle is in a full-pull condition;

determine a ground speed of the vehicle in the full-pull condition;

determine whether the ground speed is below a predetermined ground speed value;

determine whether at least one of the plurality of key indicator values is outside of a predetermined specification for the corresponding key indicator value;

conclude that low ground speed is the result of a mechanical condition when at least one of the plurality of key indicator values is outside of specification; and conclude that low ground speed is the result of an operational condition when none of the measured plurality key indicator values is outside of specification; and a display system operatively associated with said processing system, said processing system displaying on said display system at least information relating to said conclusions.

* * * * *